US011940197B2

(12) United States Patent
McDonnell et al.

(10) Patent No.: US 11,940,197 B2
(45) **Date of Patent: *Mar. 26, 2024**

(54) COOLING SYSTEMS AND METHODS USING TWO CIRCUITS WITH WATER FLOW IN A COUNTER FLOW AND IN A SERIES OR PARALLEL ARRANGEMENT

(71) Applicant: INERTECH IP LLC, Danbury, CT (US)

(72) Inventors: Gerald McDonnell, Spring Hill, FL (US); Ming Zhang, Weston, CT (US); John Costakis, Glasco, NY (US); Earl Keisling, Ridgefield, CT (US)

(73) Assignee: INERTECH IP LLC, Plano, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/720,730

(22) Filed: Apr. 14, 2022

(65) Prior Publication Data

US 2022/0316786 A1 Oct. 6, 2022

Related U.S. Application Data

(63) Continuation of application No. 14/534,957, filed on Nov. 6, 2014, now Pat. No. 11,306,959.

(60) Provisional application No. 61/900,602, filed on Nov. 6, 2013.

(51) Int. Cl.

| | |
|---|---|
| ***F25D 17/02*** | (2006.01) |
| ***F25B 1/00*** | (2006.01) |
| ***F25B 25/00*** | (2006.01) |

(52) U.S. Cl.

CPC ..... *F25D 17/02* (2013.01); *F25B 25/005* (2013.01); *F25B 1/00* (2013.01); *F25B 1/005* (2013.01); *F25B 2339/047* (2013.01)

(58) Field of Classification Search

CPC ..... F25D 17/02; F25B 1/005; F25B 25/005; F25B 2339/047

See application file for complete search history.

(56) References Cited

U.S. PATENT DOCUMENTS

| | | | |
|---|---|---|---|
| 5,715,693 | A | 2/1998 | Walt et al. |
| 6,116,048 | A | 9/2000 | Hebert |
| 6,330,809 | B1 | 12/2001 | Boardman et al. |
| 6,374,627 | B1 | 4/2002 | Schumacher et al. |
| 6,574,104 | B2 | 6/2003 | Patel et al. |
| 6,640,561 | B2 | 11/2003 | Trecate et al. |

(Continued)

FOREIGN PATENT DOCUMENTS

| | | | |
|---|---|---|---|
| AU | 2010256688 | A1 | 1/2012 |
| CN | 101442893 | A | 5/2009 |

(Continued)

OTHER PUBLICATIONS

Air-Cooled High-Performance Data Centers: Case Studies and Best Methods, 2006.

(Continued)

*Primary Examiner* — Schyler S Sanks

(74) *Attorney, Agent, or Firm* — Weber Rosselli & Cannon LLP

(57) ABSTRACT

The cooling systems and methods of the present disclosure relate to cooling electronic equipment in data centers or any other applications that have high heat rejection temperature and high sensible heat ratio.

10 Claims, 1 Drawing Sheet

(56) References Cited

U.S. PATENT DOCUMENTS

| | | | |
|---|---|---|---|
| 6,772,604 | B2 | 8/2004 | Bash et al. |
| 6,826,922 | B2 | 12/2004 | Patel et al. |
| 6,859,366 | B2 | 2/2005 | Fink |
| 6,980,433 | B2 | 12/2005 | Fink |
| 7,046,514 | B2 | 5/2006 | Fink et al. |
| 7,106,590 | B2 | 9/2006 | Chu et al. |
| 7,173,820 | B2 | 2/2007 | Fink et al. |
| 7,406,839 | B2 | 8/2008 | Bean et al. |
| 7,418,825 | B1 | 9/2008 | Bean, Jr. |
| 7,477,514 | B2 | 1/2009 | Campbell et al. |
| 7,569,954 | B2 | 8/2009 | Tolle et al. |
| 7,660,116 | B2 | 2/2010 | Claassen et al. |
| 7,660,121 | B2 | 2/2010 | Campbell et al. |
| 7,684,193 | B2 | 3/2010 | Fink et al. |
| 7,730,731 | B1 | 6/2010 | Bash et al. |
| 7,738,251 | B2 | 6/2010 | Clidaras et al. |
| 7,804,687 | B2 | 9/2010 | Copeland et al. |
| 7,855,890 | B2 | 12/2010 | Kashirajima et al. |
| 7,864,527 | B1 | 1/2011 | Whitted |
| 7,881,057 | B2 | 2/2011 | Fink et al. |
| 7,903,404 | B2 | 3/2011 | Tozer et al. |
| 7,903,409 | B2 | 3/2011 | Patel et al. |
| 7,907,406 | B1 | 3/2011 | Campbell et al. |
| 7,957,144 | B2 | 6/2011 | Goettert et al. |
| 7,963,119 | B2 | 6/2011 | Campbell et al. |
| 8,000,103 | B2 | 8/2011 | Lipp et al. |
| 8,031,468 | B2 | 10/2011 | Bean, Jr. et al. |
| 8,118,084 | B2 | 2/2012 | Harvey |
| 8,120,916 | B2 | 2/2012 | Schmidt et al. |
| 8,146,374 | B1 | 4/2012 | Zien |
| 8,184,435 | B2 | 5/2012 | Bean, Jr. et al. |
| 8,189,334 | B2 | 5/2012 | Campbell et al. |
| 8,199,504 | B2 | 6/2012 | Kashirajima et al. |
| 8,208,258 | B2 | 6/2012 | Campbell et al. |
| 8,218,322 | B2 | 7/2012 | Clidaras et al. |
| 8,261,565 | B2 | 9/2012 | Borror et al. |
| 8,289,710 | B2 | 10/2012 | Spearing et al. |
| 8,297,069 | B2 | 10/2012 | Novotny et al. |
| 8,320,125 | B1 | 11/2012 | Hamburgen et al. |
| 8,351,200 | B2 | 1/2013 | Arimilli et al. |
| 8,387,687 | B2 | 3/2013 | Baer |
| 8,392,035 | B2 | 3/2013 | Patel et al. |
| 8,405,977 | B2 | 3/2013 | Lin |
| 8,432,690 | B2 | 4/2013 | Fink et al. |
| 8,456,840 | B1 | 6/2013 | Clidaras et al. |
| 8,457,938 | B2 | 6/2013 | Archibald et al. |
| 8,472,182 | B2 | 6/2013 | Campbell et al. |
| 8,514,575 | B2 | 8/2013 | Goth et al. |
| 8,583,290 | B2 | 11/2013 | Campbell et al. |
| 8,689,861 | B2 | 4/2014 | Campbell et al. |
| 8,760,863 | B2 | 6/2014 | Campbell et al. |
| 8,763,414 | B2 | 7/2014 | Carlson et al. |
| 8,780,555 | B2 | 7/2014 | Fink et al. |
| 8,783,052 | B2 | 7/2014 | Campbell et al. |
| 8,797,740 | B2 | 8/2014 | Campbell et al. |
| 8,813,515 | B2 | 8/2014 | Campbell et al. |
| 8,817,465 | B2 | 8/2014 | Campbell et al. |
| 8,817,474 | B2 | 8/2014 | Campbell et al. |
| 8,824,143 | B2 | 9/2014 | Campbell et al. |
| 8,839,638 | B2 | 9/2014 | Kashirajima et al. |
| 8,867,204 | B1 | 10/2014 | Gardner |
| 8,879,257 | B2 | 11/2014 | Campbell et al. |
| 2002/0172007 | A1 | 11/2002 | Pautsch |
| 2003/0061824 | A1 | 4/2003 | Marsala |
| 2007/0227710 | A1 | 10/2007 | Belady et al. |
| 2008/0250807 | A1 | 10/2008 | Park |
| 2009/0086428 | A1 | 4/2009 | Campbell et al. |
| 2009/0154096 | A1 | 6/2009 | Iyengar et al. |
| 2010/0032142 | A1 | 2/2010 | Copeland et al. |
| 2010/0136895 | A1 | 6/2010 | Sgro |
| 2010/0300650 | A1 | 12/2010 | Bean, Jr. |
| 2011/0198057 | A1 | 8/2011 | Lange et al. |
| 2011/0265983 | A1 | 11/2011 | Pedersen |
| 2011/0313576 | A1 | 12/2011 | Nicewonger |
| 2012/0103009 | A1* | 5/2012 | Ding ..... F25B 39/02 62/526 |
| 2012/0103591 | A1 | 5/2012 | Tozer |
| 2012/0127657 | A1* | 5/2012 | Keisling ..... F28D 15/00 361/679.53 |
| 2012/0174612 | A1 | 7/2012 | Madara et al. |
| 2013/0180278 | A1 | 7/2013 | Yamashita et al. |

FOREIGN PATENT DOCUMENTS

| | | | |
|---|---|---|---|
| CN | 100584168 | C | 1/2010 |
| CN | 101686629 | A | 3/2010 |
| CN | 102334396 | A | 1/2012 |
| CN | 102461357 | A | 5/2012 |
| DE | 102012218873 | A1 | 5/2013 |
| EP | 1604263 | A2 | 12/2005 |
| JP | 2008287733 | A | 11/2008 |
| JP | 5113203 | B2 | 1/2013 |
| JP | 5209584 | B2 | 6/2013 |
| JP | 5243929 | B2 | 7/2013 |
| JP | 5244058 | B2 | 7/2013 |
| JP | 5301009 | B2 | 9/2013 |
| JP | 5308750 | B2 | 10/2013 |

OTHER PUBLICATIONS

Data Center Evolution A Tutorial on State of the Art, Issues, and Challenges, 2009.

E. Stamper, R. Koral and C. Strock, Handbook of air conditioning, heating, and ventilating. New York: Industrial Press, 1979.

Heat Transfer/Heat Exchangers—Wikibooks—Aug. 11, 2011.

HP Modular Cooling System Site Preparation Guide, 206-2007.

Liebert Xtreme Density—System Design Manual, 2009.

Reduced-Order Modeling Of Multiscale Turbulent Convection: Application to Data Center Thermal Management, May 2006.

Refrigeration Basics 101—Nelson, Eric—Dec. 24, 2012.

Weatherman: Automated, Online, and Predictive Thermal Mapping and Management for Data Centers, 2006.

* cited by examiner

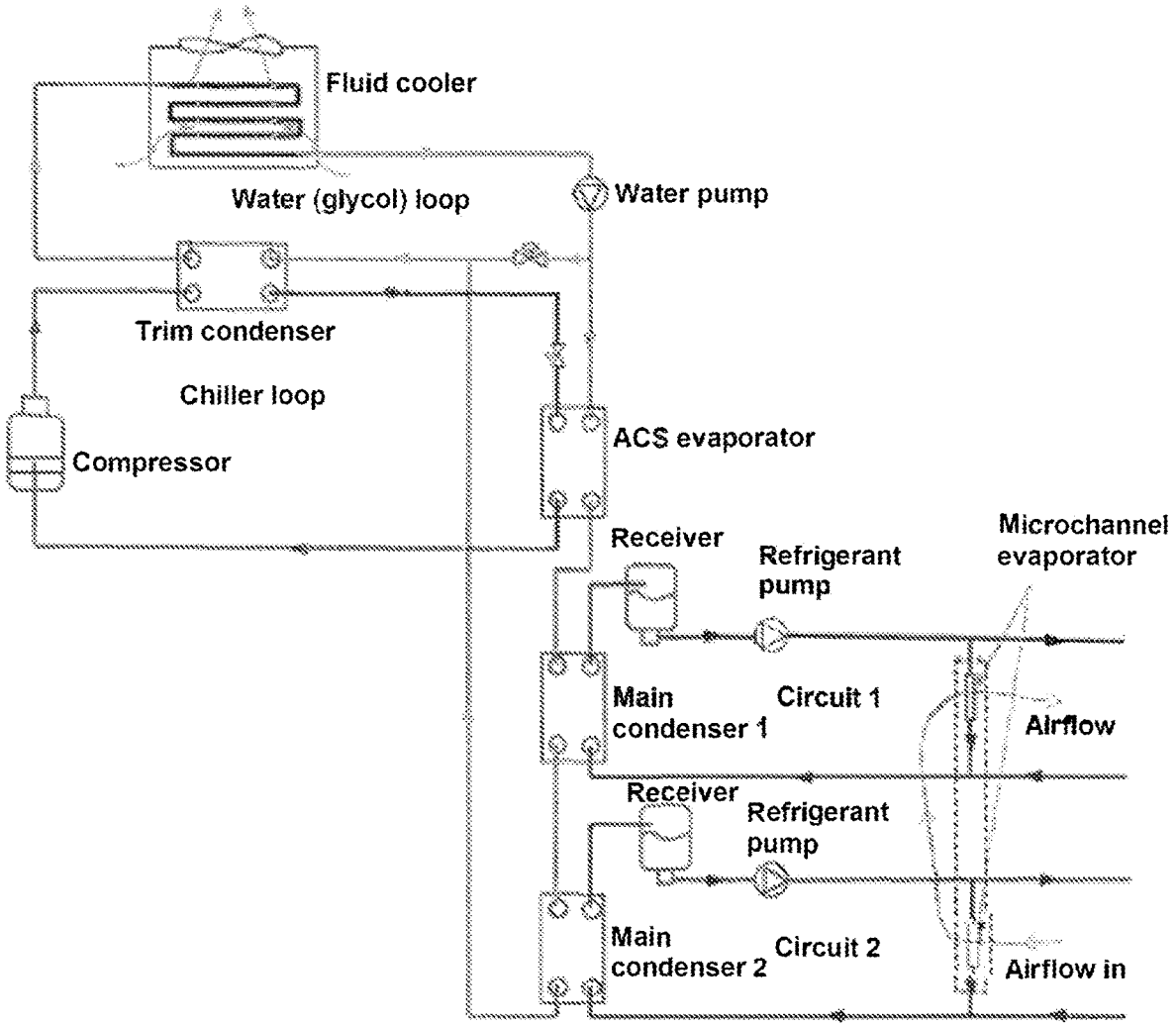
Fluid cooler
Water (glycol) loop
Water pump
Trim condenser
Chiller loop
Compressor
ACS evaporator
Receiver
Refrigerant pump
Microchannel evaporator
Main condenser 1
Circuit 1
Airflow
Receiver
Refrigerant pump
Main condenser 2
Circuit 2
Airflow in

COOLING SYSTEMS AND METHODS USING TWO CIRCUITS WITH WATER FLOW IN A COUNTER FLOW AND IN A SERIES OR PARALLEL ARRANGEMENT

BACKGROUND

Conventional cooling systems do not exhibit significant reductions in energy use in relation to decreases in load demand. Air-cooled direct expansion (DX), water-cooled chillers, heat pumps, and even large fan air systems do not scale down well to light loading operation. Rather, the energy cost per ton of cooling increases dramatically as the output tonnage is reduced on conventional systems. This has been mitigated somewhat with the addition of fans, pumps, and chiller variable frequency drives (VFDs); however, their turn-down capabilities are still limited by such issues as minimum flow constraints for thermal heat transfer of air, water, and compressed refrigerant. For example, a 15% loaded air conditioning system requires significantly more than 15% power of its 100% rated power use. In most cases such a system requires as much as 40-50% of its 100% rated power use to provide 15% of cooling work.

Conventional commercial, residential, and industrial air conditioning cooling circuits require high electrical power draw when energizing the compressor circuits to perform the cooling work. Some compressor manufacturers have mitigated the power in rush and spikes by employing energy saving VFDs and other apparatuses for step loading control functions. However, the current systems employed to perform cooling functions are extreme power users.

Existing refrigerant systems do not operate well under partial or lightly loaded conditions, nor are they efficient at low temperature or "shoulder seasonal" operation in cooler climates. These existing refrigerant systems are generally required to be fitted with low ambient kits in cooler climates, and other energy robbing circuit devices, such as hot gas bypass in order to provide a stable environment for the refrigerant under these conditions.

Compressors on traditional cooling systems rely on tight control of the vapor evaporated in an evaporator coil. This is accomplished by using a metering device (or expansion valve) at the inlet of the evaporator which effectively meters the amount of liquid that is allowed into the evaporator. The expanded liquid absorbs the heat present in the evaporator coil and leaves the coil as a super-heated vapor. Tight metering control is required in order to ensure that all of the available liquid has been boiled off before leaving the evaporator coil. This can create several problems under low loading conditions, such as uneven heat distribution across a large refrigerant coil face or liquid slugging to the compressor. This latter scenario can damage or destroy a compressor.

To combat the inflexibility problems that exist on the low-end operation of refrigerant systems, manufacturers employ hot gas bypass and other low ambient measures to mitigate slugging and uneven heat distribution. These measures create a false load and cost energy to operate.

Conventional air-cooled air conditioning equipment are inefficient. The kw per ton (kilowatt electrical per ton of refrigeration or kilowatt electrical per 3.517 kilowatts of refrigeration) for the circuits are more than 1.0 kw per ton during operation in high dry bulb ambient conditions.

Evaporative assist condensing air conditioning units exhibit better kw/ton energy performance over air-cooled DX equipment. However, they still have limitations in practical operation in climates that are variable in temperature. They also require a great deal more in maintenance and chemical treatment costs.

Central plant chiller systems that temper, cool, and dehumidify large quantities of hot process intake air, such as intakes for turbine inlet air systems, large fresh air systems for hospitals, manufacturing, casinos, hotel, and building corridor supply systems are expensive to install, costly to operate, and are inefficient over the broad spectrum of operational conditions.

Existing compressor circuits have the ability to reduce power use under varying or reductions in system loading by either stepping down the compressors or reducing speed (e.g., using a VFD). There are limitations to the speed controls as well as the steps of reduction.

Gas turbine power production facilities rely on either expensive chiller plants and inlet air cooling systems, or high volume water spray systems as a means to temper the inlet combustion air. The turbines lose efficiency when the entering air is allowed to spike above 15° C. and possess a relative humidity (RH) of less than 60% RH. The alternative to the chiller plant assist is a high volume water inlet spray system. High volume water inlet spray systems are less costly to build and operate. However, such systems present heavy maintenance costs and risks to the gas turbines, as well as consume huge quantities of potable water.

Hospital intake air systems require 100% outside air. It is extremely costly to cool this air in high ambient and high latent atmospheres using the conventional chiller plant systems.

Casinos require high volumes of outside air for ventilation to casino floors. They are extremely costly to operate, and utilize a tremendous amount of water especially in arid environments, e.g., Las Vegas, Nevada in the United States.

Middle eastern and desert environments have a high impact on inlet air cooling systems due to the excessive work that a compressor is expected to perform as a ratio of the inlet condensing air or water versus the leaving chilled water discharge. The higher the delta, the more work the compressor has to perform with a resulting higher kw/ton electrical draw. As a result of the high ambient desert environment, a cooling plant will expend nearly double the amount of power to produce the same amount of cooling in a less arid environment.

High latent load environments, such as in Asia, India, Africa, and the southern hemispheres, require high cooling capacities to handle the effects of high moisture in the atmosphere. The air must be cooled and the moisture must be eliminated in order to provide comfort cooling for residential, commercial, and industrial outside air treatment applications. High latent heat loads cause compressors to work harder and require a higher demand to handle the increased work load.

Existing refrigeration process systems are normally designed and built in parallel. The parallel systems do not operate efficiently over the broad spectrum of environmental conditions. They also require extensive control operating algorithms to enable the various pieces of equipment on the system to operate as one efficiently. There are many efficiencies that are lost across the operating spectrum because the systems are piped, operated, and controlled in parallel.

There have not been many innovations in air conditioning systems and cooling equipment that address the inherent limitations of the various refrigerant cooling processes. Each conventional system exhibits losses in efficiency at high-end, shoulder, and low-end loading conditions. In addition to the non-linear power versus loading issues, environmental conditions have extreme impacts on the individual cooling processes. The conventional systems are too broadly utilized across a wide array of environmental conditions. The results are that most of the systems operate inefficiently for a vast majority of time. The reasons for the inefficiencies are based on operator misuse, misapplication for the environment, or losses in efficiency due to inherent limiting characteristics of the cooling equipment.

BRIEF DESCRIPTION OF THE DRAWINGS

FIG. 1 is a schematic flow diagram of a cooling system in accordance with embodiments of the present disclosure.

DETAILED DESCRIPTION

The present disclosure features a cooling system for data centers or for any other applications that have high heat rejection temperature and high sensible heat ratio compared to general air conditioning or refrigeration applications.

Some systems for data center cooling use two separate liquid refrigerant pump systems. Each pump system has its own water-cooled condenser, along with a chiller loop. The chiller loop includes a fluid cooler, a compressor, a trim condenser, and an air conditioning system (ACS) evaporator. When the outdoor ambient temperature is high, the chiller loop cools water from the outdoor fluid cooler. Further, if one of the two chiller loops fails to operate, the other is used as a backup. If both chiller loops are operable, the two of them can run in parallel for normal operation to obtain higher cooling capacity and energy efficiency.

The cooling systems and methods according to the present disclosure connect the water flow of the two chiller loop systems in a series, counter-flow arrangement. This design, together with optimal flow rate selection and control, significantly improves the system energy efficiency and reduces water flow rate and pipe size.

Some cooling systems use two circuits, each of which has a refrigerant pump loop and a water (or glycol) loop to condense the refrigerant. The water can be chilled (or "trimmed") by a compressor/chiller loop when the outdoor wet bulb temperature is high. The two circuits have parallel water flow. In normal operation, the two circuits work simultaneously, and the evaporators for air cooling of the two circuits are in series, and air from the high temperature circuit enters the evaporator of the low temperature circuit to be cooled further.

If one of the two circuits fails to operate, the system operates in "failure mode" or "backup mode" with only one circuit in operation. The cooling system of the present disclosure employs two circuits, but the water (or glycol) flows through the two circuits in series and counter flow pattern, resulting in higher energy efficiency, lower water flow rate, and a broader operating range, e.g., it can run with a higher outdoor wet bulb temperature.

FIG. 1 is a schematic flow diagram of a cooling system in accordance with embodiments of the present disclosure. As shown, water (or glycol) from the fluid cooler is pumped first through the ACS evaporator where it is chilled (when ambient or wetbulb temperature is high), and then through main condenser 1 and main condenser 2 of the two pumped refrigerant fluid circuits. From the main condensers, the water (or glycol/water mixture) is mixed with additional water from the outlet of the fluid cooler, and then goes through the trim condenser and finally through the fluid cooler, completing the cycle. Alternatively, the water from the main condenser 2 is mixed with the water leaving the trim condenser at the outlet of the trim condenser and returns to the fluid cooler.

The two main pumped refrigerant fluid circuits are connected to evaporators at or near the heat source (e.g., mounted on the rear doors or tops of computer server cabinets or from the ceiling above the cabinets to cool the electronic equipment). Air and water flow of the two fluid circuits is in a counter flow arrangement: warm air (e.g., 40° C.) from electronic equipment is cooled in the first evaporator to a lower temperature (e.g., 32° C.), and then air leaving fluid circuit 2 enters the evaporator of fluid circuit 1 and is further cooled (e.g., to 25° C.). In other words, chilled water from the ACS evaporator is in thermal communication with the first and second fluid circuits, and the chilled water and the refrigerant flowing through the first and second fluid circuits are in thermal counter flow: the chilled water is first in thermal communication with the refrigerant with lower temperature (corresponding to lower air temperature in the evaporator) in fluid circuit 1 through the main condenser 1, with its temperature raised, and then is in thermal communication with the refrigerant with higher temperature (corresponding to higher air temperature in the evaporator) in fluid circuit 2 through the main condenser 2, with its temperature further raised. In embodiments, the evaporators may include microchannel evaporators.

The refrigerant saturation temperature of fluid circuit 1 is maintained lower than fluid circuit 2 (e.g., 24° C. for fluid circuit 1 versus 31° C. for fluid circuit 2); the water (or glycol) from the fluid cooler or ACS evaporator with lower temperature flows through main condenser 1 to condense refrigerant vapor in fluid circuit 1, with its temperature raised, and then flows through main condenser 2 to condense refrigerant vapor in fluid circuit 2, with its temperature further raised, then flows to the trim condenser. This flow arrangement plus optimal water (or glycol) flow rate control can increase system energy efficiency and significantly reduce water flow rate, pipe size and pumping power.

The two refrigerant fluid circuits 1 and 2 shown in FIG. 1 can also be used with a chiller plant. Chilled water from the chiller plant flows through the main condenser 1 of the fluid circuit 1, and then through the main condenser 2 of the fluid circuit 2, and then returns to the chiller plant with a higher temperature. In other words, the chiller plant may replace the water and chiller loops of FIG. 1. Thus, the output of the chiller plant is provided to the input of the water side of main condenser 1 and the output of the water side of main condenser 2 is provided to the input of the chiller plant. The chiller plant may provide chilled water to multiple refrigerant distribution units including fluid circuits 1 and 2. Compared to conventional CRAC units, this design uses much less water flow rate, and consumes much less pumping and compressor power.

Although the illustrative embodiments of the present disclosure have been described herein with reference to the accompanying drawings, it is to be understood that the disclosure is not limited to those precise embodiments, and that various other changes and modification may be effected therein by one skilled in the art without departing from the scope or spirit of the disclosure.

In embodiments, the water flow through the trim condenser and the water flow through the ACS evaporator, the first main condenser, and the second main condenser, may be in a series or in a parallel arrangement. FIG. 1 shows the in series arrangement. The in parallel arrangement may be formed by disconnecting the output of the water side of main condenser 2 from the fluid line or fluid conduit connected between the water pump and the input to the water loop side of the trim condenser, and connecting the output of the water side of main condenser 2 to the fluid line or fluid conduit connected between the output of the water loop side of the trim condenser and the input to the fluid cooler.

Other applications for the cooling system of the present disclosure include turbine inlet air cooling, laboratory system cooling, and electronics cooling, among many others.

What is claimed is:

1. A cooling system comprising:

a first refrigerant circuit including: a first evaporator coil in thermal communication with an air outtake flow to a heat load, and a first condenser in fluid communication with the first evaporator coil;

a second refrigerant circuit including: a second evaporator coil in thermal communication with an air intake flow from the heat load, and a second condenser in fluid communication with the second evaporator coil, wherein the second evaporator coil is in air flow series with the first evaporator coil such that the air intake flow is coupled to the air outtake flow, and the second condenser is in fluid communication with the first condenser;

a water loop in fluid communication with a free-cooling fluid cooler and the first and second condensers such that water output from the free-cooling fluid cooler flows to the second condenser from the first condenser;

a chiller loop in thermal communication with the water loop and the first and second condensers, the chiller loop including a trim condenser in fluid communication with: the chiller loop at a first trim fluid path of the trim condenser, and the water loop at a second trim fluid path of the trim condenser; and an air conditioning system evaporator in thermal communication with the first and second condensers, a first evaporator fluid path of the air conditioning system evaporator in fluid communication with the first trim fluid path, and a second evaporator fluid path of the air conditioning system evaporator in fluid communication with the water loop, wherein the second evaporator fluid path is in fluid communication with the second trim fluid path via the first and second condensers, and wherein a fluid flowing through the chiller loop and a fluid flowing through the water loop flow in opposite directions through the trim condenser.

2. The cooling system according to claim 1, wherein the first and second evaporator coils are microchannel evaporator coils.

3. The cooling system according to claim 1, wherein the chiller loop includes a compressor in fluid communication with a fluid output of the first evaporator fluid path and a fluid input of the first trim fluid path.

4. The cooling system according to claim 3, wherein chilled water from the air conditioning system evaporator is in thermal communication with the first and second refrigerant circuits, and wherein the fluid flowing through the chiller loop and a refrigerant flowing through the first and second refrigerant circuits are in thermal counter flow.

5. The cooling system according to claim 4, wherein a refrigerant saturation temperature of the first refrigerant circuit is less than a refrigerant saturation temperature of the second refrigerant circuit.

6. The cooling system according to claim 3, wherein water flow through the trim condenser is in a series or in a parallel arrangement with water flow through the air conditioning system evaporator, the first condenser, and the second condenser.

7. A cooling system, comprising:

a first refrigerant circuit including: a first evaporator coil in thermal communication with an air outtake flow to a heat load, and a first condenser in fluid communication with the first evaporator coil;

a second refrigerant circuit including: a second evaporator coil in thermal communication with an air intake flow from the heat load, and a second condenser in fluid communication with the second evaporator coil, wherein the second evaporator coil is in air flow series with the first evaporator coil such that the air intake flow is coupled to the air outtake flow, and the second condenser is in fluid communication with the first condenser;

a water loop in fluid communication with a free-cooling fluid cooler and the first and second condensers such that water output from the free-cooling fluid cooler flows to the second condenser via the first condenser;

a chiller loop in thermal communication with the water loop and the first and second condensers, the chiller loop including:

a trim condenser including first and second trim fluid paths;

an air conditioning system evaporator in thermal communication with the first and second condensers, the air conditioning system evaporator including first and second evaporator fluid paths in fluid communication with each other; and a compressor in fluid communication with a fluid output of the first evaporator fluid path and a fluid input of the first trim fluid path, wherein the first refrigerant circuit includes the first condenser, which includes first and second condenser fluid paths, a first fluid receiver in fluid communication with the first condenser fluid path, and a first refrigerant pump in fluid communication with the first fluid receiver, wherein the second condenser fluid path is in fluid communication with the second evaporator fluid path, wherein the second refrigerant circuit includes: the second condenser, which includes a third condenser fluid path and a fourth condenser fluid path, a second fluid receiver in fluid communication with the third condenser fluid path, and a second refrigerant pump in fluid communication with the second fluid receiver, wherein the fourth condenser fluid path is in fluid communication with the second condenser fluid path and the water loop, wherein the water loop is in fluid communication with the second trim fluid path, wherein water flows through the air conditioning system evaporator to the trim condenser via the first and second condensers, and wherein a fluid flowing through the chiller loop and a fluid flowing through the water loop flow in opposite directions through the trim condenser.

8. The cooling system according to claim 7, wherein the first and second evaporator coils are microchannel evaporator coils.

9. The cooling system according to claim 7, wherein the first refrigerant circuit further includes a first fluid receiver in fluid communication with a first fluid path of the first condenser, wherein the first refrigerant pump is in fluid communication with the first fluid receiver, and wherein a second fluid path of the first condenser is in fluid communication with the second fluid path of the air conditioning system evaporator.

10. The cooling system according to claim 7, wherein the second refrigerant circuit includes a second fluid receiver in fluid communication with the third condenser fluid path, wherein the second refrigerant pump is in fluid communication with the second fluid receiver, and wherein a fourth condenser fluid path is in fluid communication with the second condenser fluid path and the water loop.

* * * * *